US008215505B2

(12) United States Patent
Lee et al.

(10) Patent No.: US 8,215,505 B2
(45) Date of Patent: Jul. 10, 2012

(54) STRUCTURE OF CAP HAVING STORAGE SPACE

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 368 days.

(21) Appl. No.: 10/592,028

(22) PCT Filed: Mar. 8, 2005

(86) PCT No.: PCT/KR2005/000641

§ 371 (c)(1),
(2), (4) Date: Sep. 7, 2006

(87) PCT Pub. No.: WO2005/091725

PCT Pub. Date: Oct. 6, 2005

(65) Prior Publication Data

US 2007/0193893 A1 Aug. 23, 2007

(30) Foreign Application Priority Data

| | | |
|---|---|---|
| Mar. 8, 2004 | (KR) | 10-2004-0016669 |
| Mar. 8, 2004 | (KR) | 10-2004-0016670 |
| Mar. 8, 2004 | (KR) | 10-2004-0016671 |
| Mar. 8, 2004 | (KR) | 10-2004-0016672 |
| Mar. 22, 2004 | (KR) | 10-2004-0020550 |

(51) Int. Cl.
*B65D 47/00* (2006.01)

(52) U.S. Cl. ..... 215/228; 215/DIG. 8; 206/219

(58) Field of Classification Search ..... 220/520, 220/521; 215/228, DIG. 8; 206/219, 221, 206/222, 568

See application file for complete search history.

(56) References Cited

U.S. PATENT DOCUMENTS

| | | | | |
|---|---|---|---|---|
| 4,203,517 | A * | 5/1980 | Hildebrandt et al. | 206/221 |
| 4,386,696 | A * | 6/1983 | Goncalves | 206/221 |
| 4,513,861 | A | 4/1985 | Baram | 206/219 |
| 4,667,818 | A | 5/1987 | Evans | 206/219 |
| 5,372,267 | A * | 12/1994 | Hofmann | 215/220 |
| 6,170,654 | B1 * | 1/2001 | Gartner et al. | 206/219 |
| 2002/0020636 | A1 * | 2/2002 | Bergamini et al. | 206/219 |
| 2003/0213709 | A1 * | 11/2003 | Gibler et al. | 206/219 |

FOREIGN PATENT DOCUMENTS

| | | |
|---|---|---|
| EP | 0 077 556 | 10/1982 |
| EP | 0 093 090 | 4/1983 |
| KR | 2003-0096162 | 12/2003 |
| KR | 2003-0096163 | 12/2003 |
| KR | 2004-0014638 | 2/2004 |
| WO | WO 2005/049430 | 6/2005 |

OTHER PUBLICATIONS

"A Closure for Bottles and the Like of the Type including a Breakable Bottom Reservoir to Break During Use.", http://v3.espacenet.com/textdoc?DB=EPODOC&IDX=EP0093090&F=0, one page, Dec. 12, 2006.

International Search Report, PCT/KR2005/000641, 2 pages.

* cited by examiner

*Primary Examiner* — Anthony Stashick
*Assistant Examiner* — Jeffrey Allen
(74) *Attorney, Agent, or Firm* — Westman, Champlin & Kelly, P.A.

(57) ABSTRACT

A cap assembly that can be associated with a container storing a primary material includes a lid fixed on a top of the container and having an exhausting portion projected upward, a cap main body detachably coupled to the exhausting portion of the lid and having a storage tube extending downward to define a storage chamber for storing a secondary material, and an inner cap body detachably coupled to the storage tube.

5 Claims, 9 Drawing Sheets

STRUCTURE OF CAP HAVING STORAGE SPACE

CROSS-REFERENCE TO RELATED APPLICATION

This application is a Section 371 National Stage Application of International Application No. PCT/KR2005/000641, filed 8 Mar. 2005 and published as WO 2005/091725 A2 on 6 Oct. 2005, in English, the application of which is based on and claims the benefit of Korean Patent Application No. 10-2004-0016670 filed on Mar. 8, 2004; Korean Patent Application No. 10-2004-0016671 filed on Mar. 8, 2004; Korean Patent Application No. 10-2004-0016672 filed on Mar. 8, 2004; Korean Patent Application No. 10-2004-0016669 filed on Mar. 8, 2004; Korean Patent Application No. 10-2004-0020550 filed on Mar. 22, 2004, the contents of which is hereby incorporated by reference in its entirety.

TECHNICAL FIELD

The present invention relates to a cap with a storage chamber for secondary material, and more particularly, to a cap with a storage chamber for secondary material that will be mixed with primary material contained in a container associated with the cap by simple opening the cap.

BACKGROUND ART

In a variety of industrial field, it is sometimes necessary to mix two or more different materials with each other to prepare a mixture, prior to using the mixture.

For example, when it comes to beverage industrial filed, users wishes to add a variety of flavors or vitamin to the water. To this end, the user purchases the flavor or vitamin and the separated bottle water and mixes the flavor or the vitamin with the bottle water. However, it is very troublesome for the user to do so.

SUMMARY OF THE INVENTION

Therefore, the present invention has been made in an effort to solve the above-described problems of the conventional art.

It is an object of the present invention to provide a cap with a storage chamber for a secondary material that will be mixed with a primary material contained in a container associated with the cap by simply opening the cap.

It is another object of the present invention to provide a cap with a storage chamber for a secondary material, which is designed considering a safety by preventing an inner cap member separated from the cap from being removed.

It is another object of the present invention to provide a cap with a storage chamber for a secondary material, which can be made with less expenses.

To achieve the above objects, the present invention provides a cap assembly that can be associated with a container storing a primary material, the cap assembly including a lid fixed on a top of the container and having an exhausting portion projected upward, a cap main body detachably coupled to the exhausting portion of the lid and having a storage tube extending downward to define a storage chamber for storing a secondary material, and an inner cap body detachably coupled to the storage tube.

BRIEF DESCRIPTION OF THE DRAWINGS

FIG. 5 is a sectional view illustrating an operation of a cap with a storage chamber according to the present invention;

FIG. 9 is a view of a modified example of a lid.

BEST MODE FOR CARRYING OUT THE INVENTION

Figure 1:
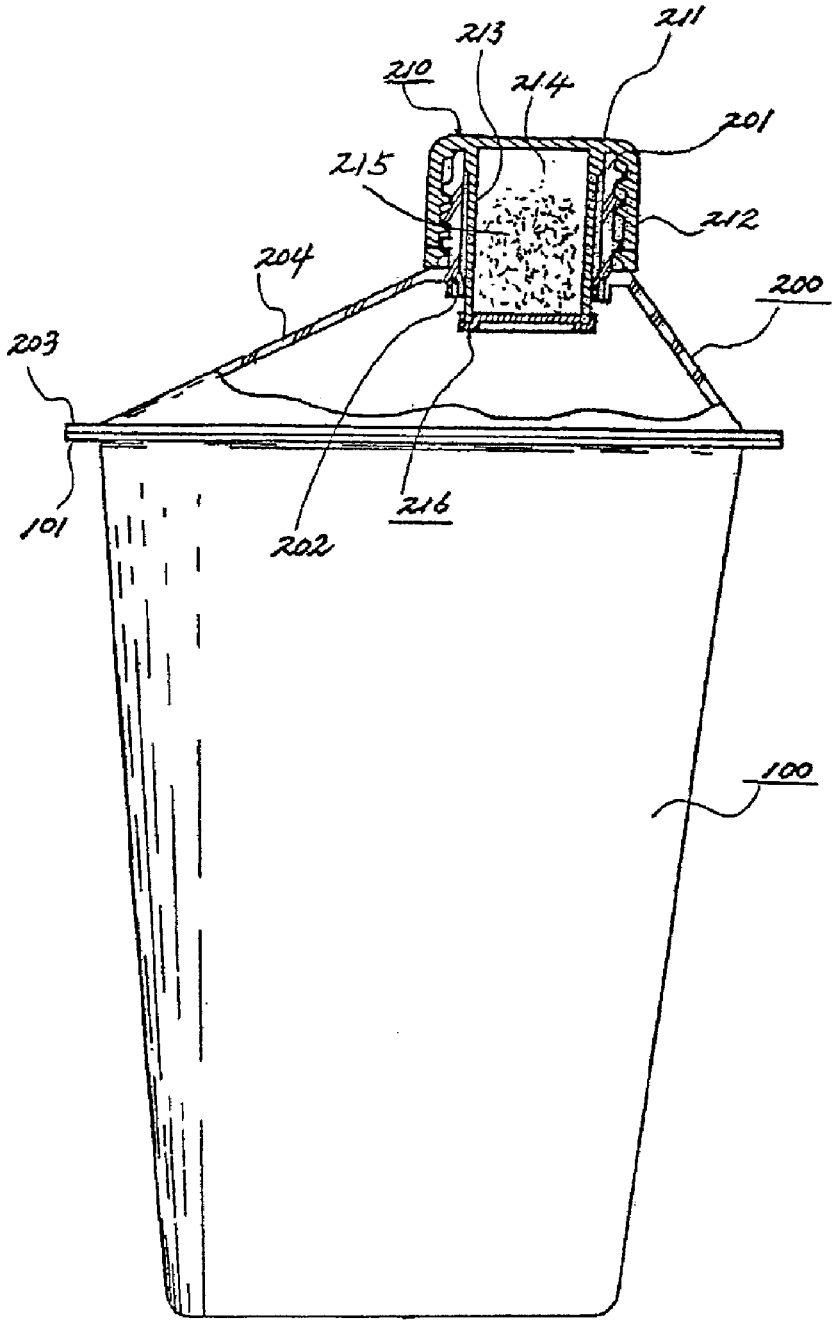
FIG. 1 is a partial sectional view of a cap with a storage chamber according to a first embodiment of the present invention.
Figure 2:
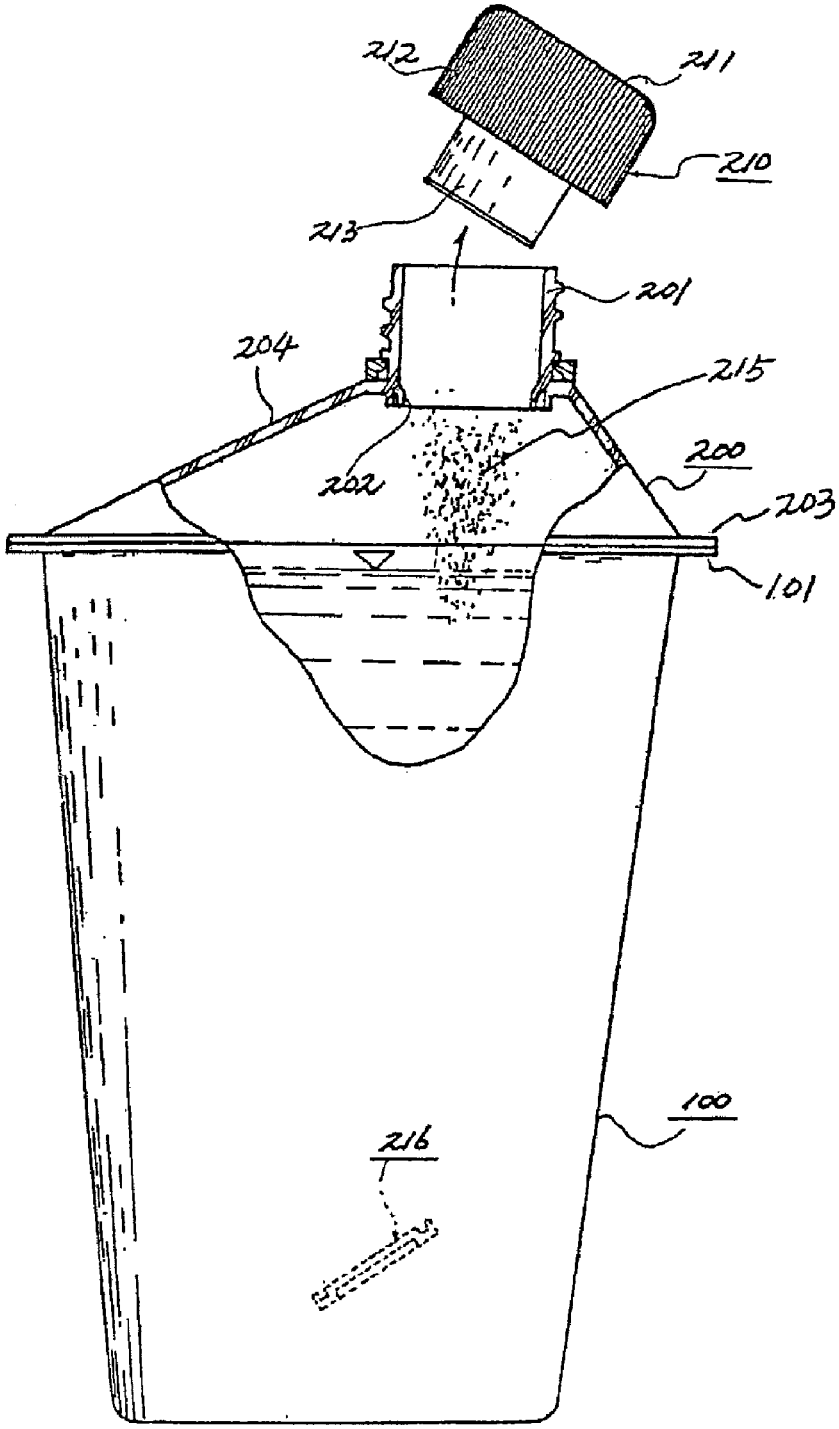
FIG. 2 is a partial sectional view illustrating an operational state of a cap with a storage chamber according to a first embodiment of the present invention.

Preferred embodiments of the present invention will be described more in detail hereinafter in conjunction with the accompanying drawings. Wherever possible, the same reference numerals will be used throughout the drawings to refer to the same or like parts.

FIG. 1 shows a cap assembly with a storage capacity according to a first embodiment of the present invention. A container main body 100 has an opened top and an attaching portion 101 formed at a top edge.

A lid 200 is attached on the top edge of the container main body 100. The lid 200 is formed in a cone-shape and provided with an exhausting portion 201. A seal step 202 is formed extending downward from the exhausting portion 201.

The lid 200 is provided at a lower end with an attaching portion 203 that is to be attached to the attaching surface 101. A cover portion 204 is formed at a lower portion of the attaching portion 203 and the exhaust portion 201.

Meanwhile, the exhaust portion 201 is coupled to a cap body 210. The cap body 210 includes an upper portion 211, a side portion 212 extending downward from the edge of the upper portion 211, a storage tube 213 extending from the upper portion 211 and spaced from the side portion 212, a storage chamber 214 formed inside the storage tube 213 to store a secondary material 215 such as powder, and an inner cap body 216 detachably attached on a lower portion of the storage tube 213.

An outer surface of the storage tube 213 tightly contacts an inner surface of the seal step 202 to prevent a primary material from leaking.

In the above-described embodiment, the primary material is stored in the container main body 100 and a cap body 210 is coupled to the exhaust portion 201. At this point, the secondary material 215 is filled in the storage chamber 214. In this state, the inner cap body 216 is coupled to the lower portion and the attaching portions 101 and 203 are attached to each other.

At this point, when the cap body 210 is separated from the exhausting portion 201, the inner cap body 216 is separated from the storage tube 213 by the seal step 202. As a result, the secondary material stored in the storage chamber 214 falls into the container body 100 to be mixed with the primary material contained in the container body 100. The mixed material can be exhausted through the exhausting portion 201.

The inner cap body 216 falls down into the container main body 100 cannot be exhausted by the seal step 202, thereby preventing the user to inadvertently swallowing the inner cap body 216.

Figure 3:
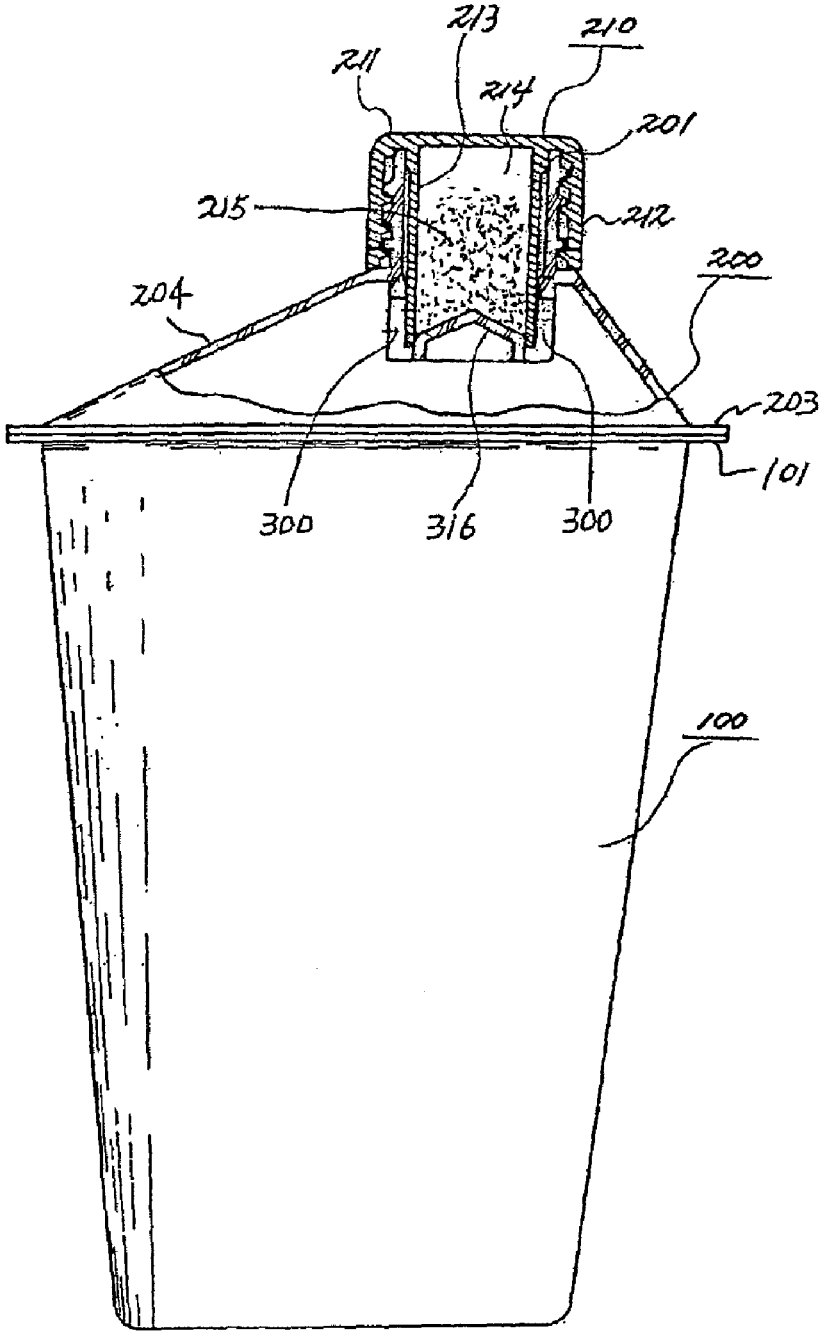
FIG. 3 is a sectional view of a second embodiment of the present invention.

FIG. 3 shows a second embodiment of the present invention.

A falling chamber (or space) 300 is formed extending inward of a container body 100 from an exhausting portion 201 formed on a lid 200. An inner cap body 316 is inserted into a bottom of a storage tube 213 coupled on a lower portion of the falling chamber 300.

When the cap body 210 is separated from the exhausting portion 201, the inner cap body 316 is separated from the storage tube 213 to allow the secondary material to be mixed with the primary material in the container main body 100.

Figure 4:
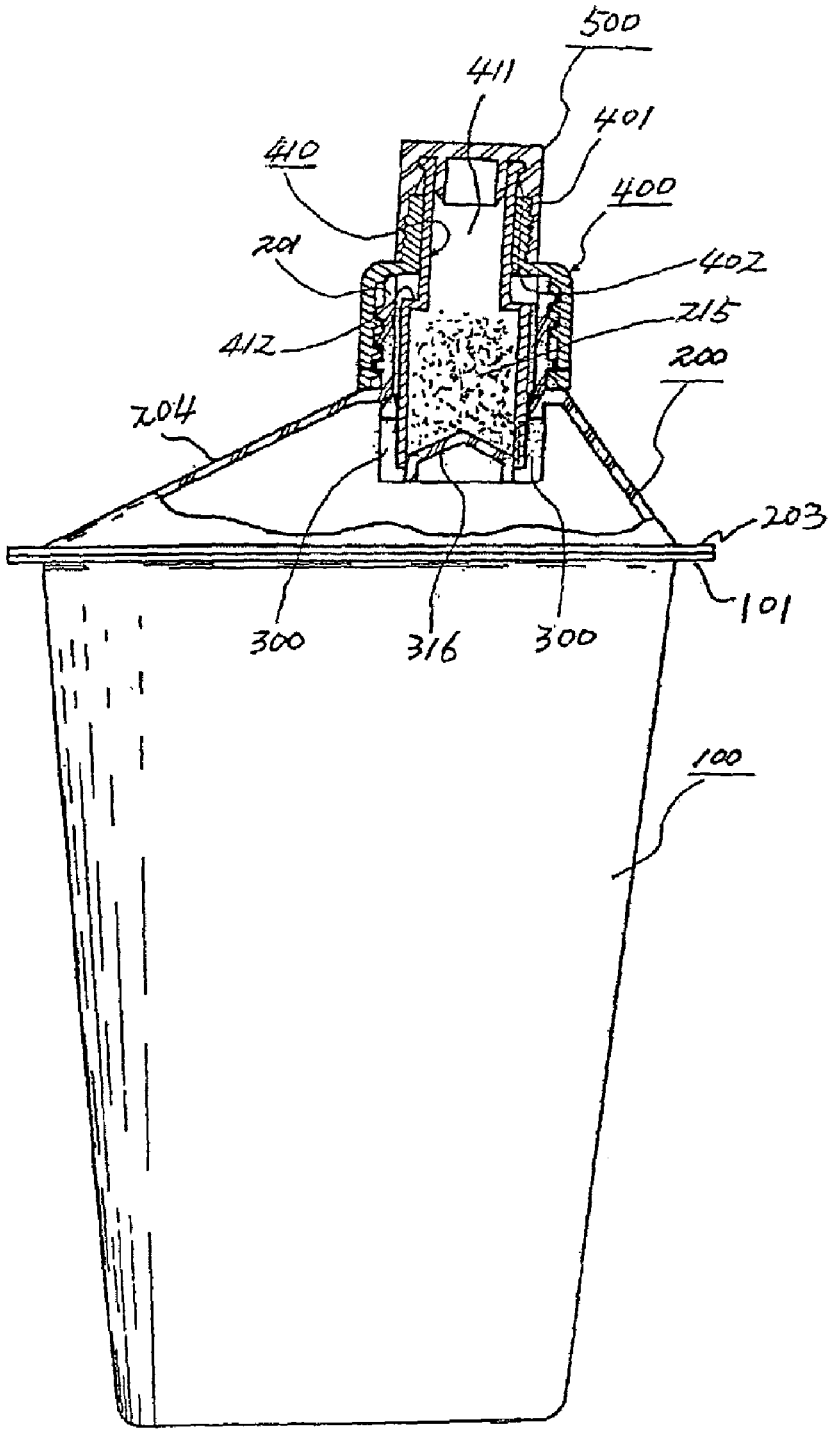
FIGS. 4 and 5 are views of a third embodiment of the present invention.
Figure 5:
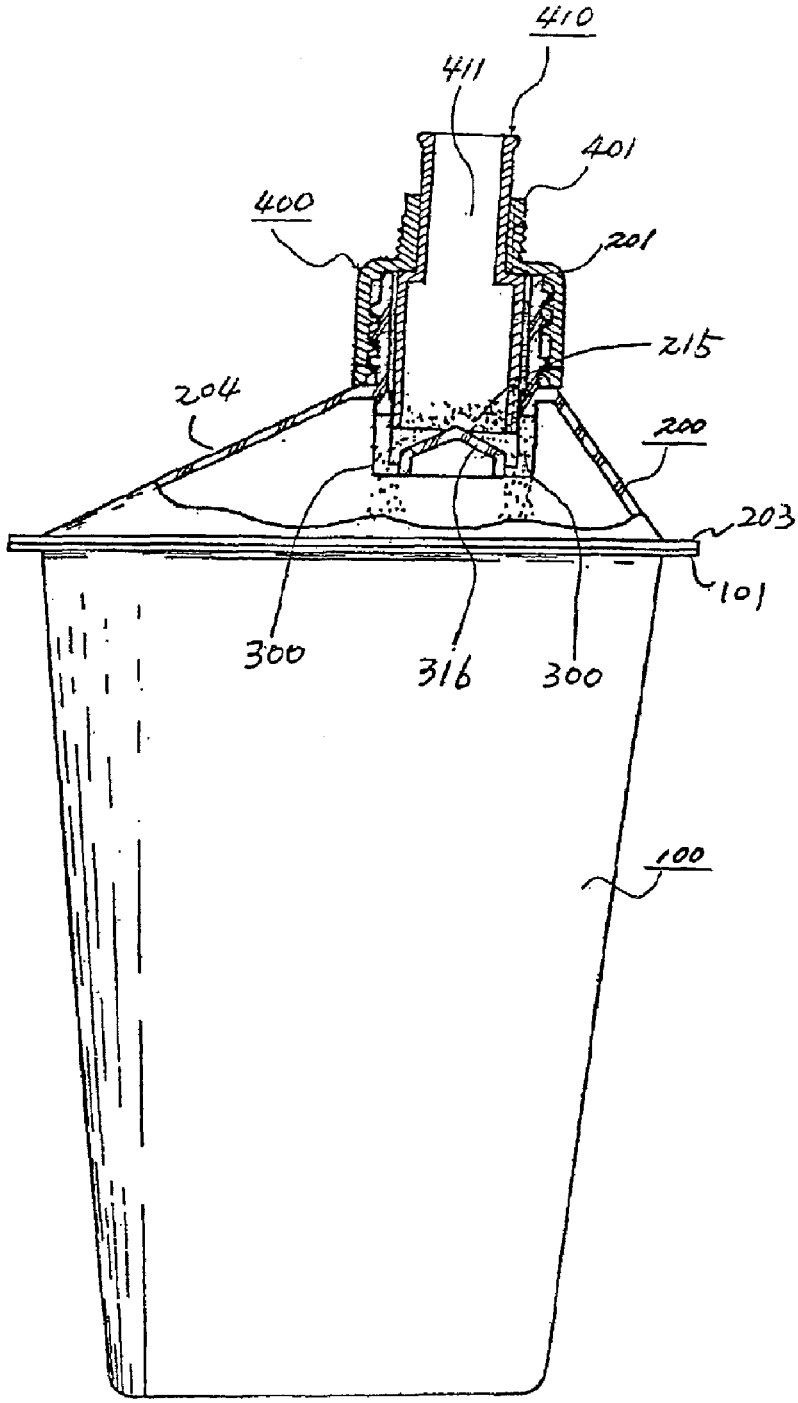

FIGS. 4 and 5 show a third embodiment of the present invention.

A cap body 400 is coupled to an exhausting portion 201 of a lid 200. The cap body 400 is provided at an upper portion with an exhausting portion 401 to which an outer cap 500 is detachably coupled to the exhausting portion 401. A hooking step 402 is formed on a lower portion of the exhausting portion 401 and a storage member 410 functioning as a straw is inserted in the exhausting portion 401. The storage member 410 defines a storage chamber 411 in which the secondary material 215 is stored. A stopper 412 on which the hooking step 402 may be caught is formed on a lower-center portion of the storage member 410.

The lower end of the storage member 410 is tightly fitted around the inner cap body 316 to prevent the secondary material 215 from inadvertently exhausted.

The storage member 410 is coupled to the outer cap 500 to elevate together with an outer cap body 500. After the storage member 410 is elevated by a predetermined height by the outer cap 500, the storage member 410 is separated from the outer cap 500.

The secondary material 215 is exhausted to a falling chamber (or space) 300 that is opened by the storage member 410 that elevates when the outer cap body 500 is separated.

Figure 6:
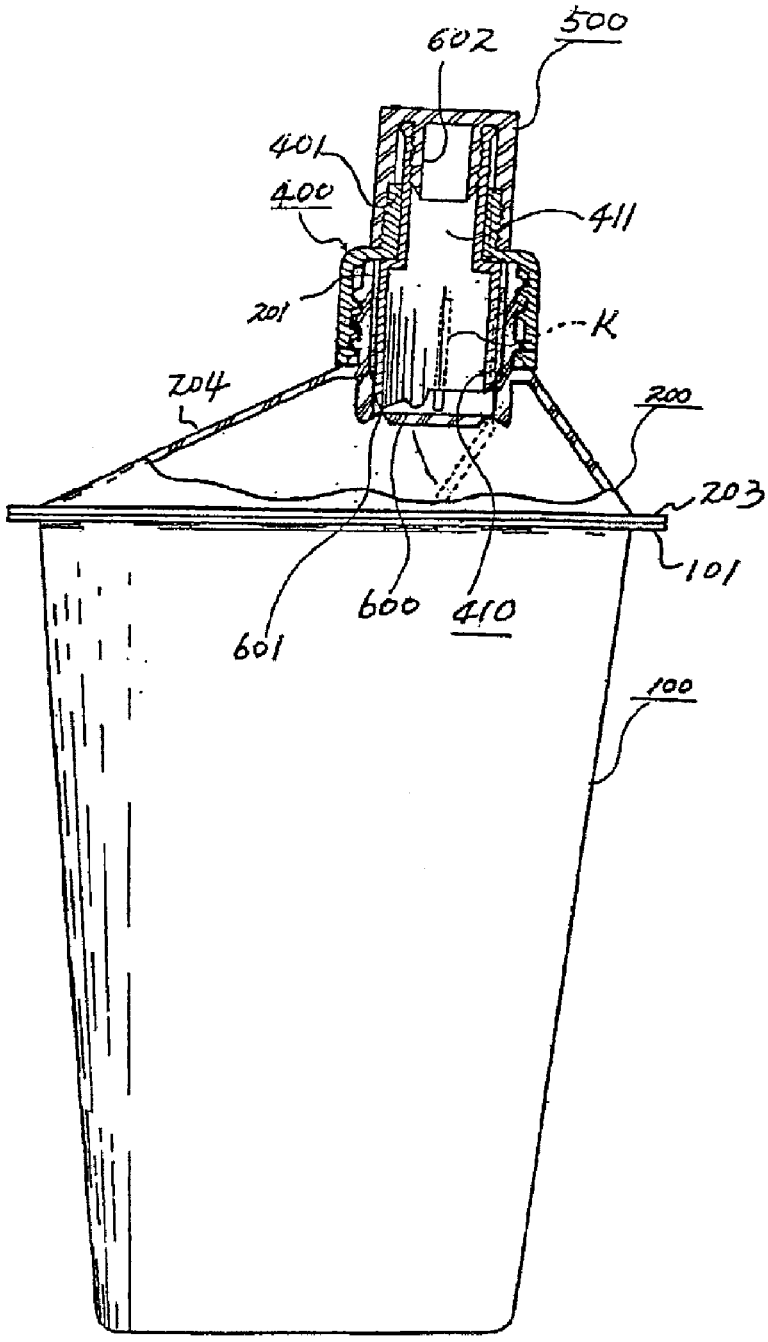
FIG. 6 is a sectional view of a fourth embodiment of the present invention.

FIG. 6 shows a fourth embodiment of the present invention.

The structure of the container main body 100 and the cap body 400 are identical to those of the cap body third embodiment.

A cutting plate 600 is integrally formed on a bottom of an exhausting portion 201 of a lid 200 to be capable of being cut away by a cutting line 601. A storage member 410 is inserted in the exhausting portion 401 of the cap body 400. An outer cap body 500 is detachably coupled to an outer portion of the exhausting portion 401.

The storage member 410 functioning as a straw has an pointed extreme end and is coupled to a key groove K formed on an inner surface of the exhaust portion 201, thereby being prevented from rotating. An inner coupling portion 602 is screw-coupled to an inner surface of the storage member 410.

When the outer cap body 500 is elevated by the screw-operation with the exhausting portion 401, the storage member 410 descends to cut the cutting plate 600.

As a result, the secondary material stored in a storage chamber 411 formed in the storage member 410 can be mixed with the primary material contained in the container main body 100.

At this point, the storage member 410 cannot rotate by the key groove K, thereby descending when the outer cap body 500 ascends.

Figure 7:
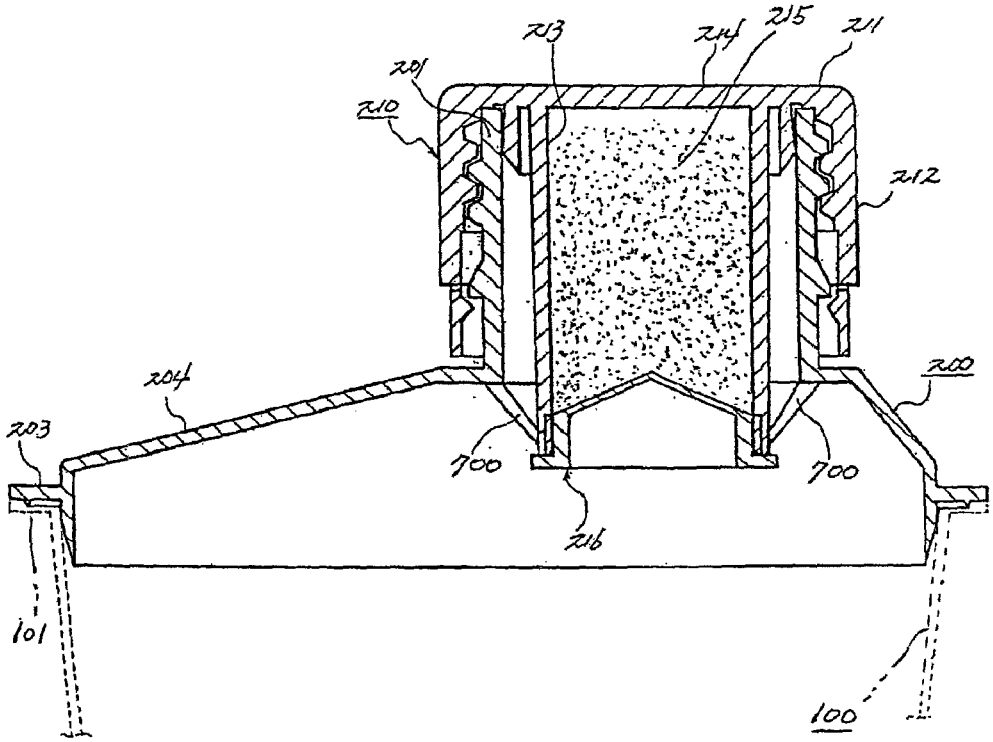
FIGS. 7 through 9 are views of a fifth embodiment of the present invention.
Figure 8:
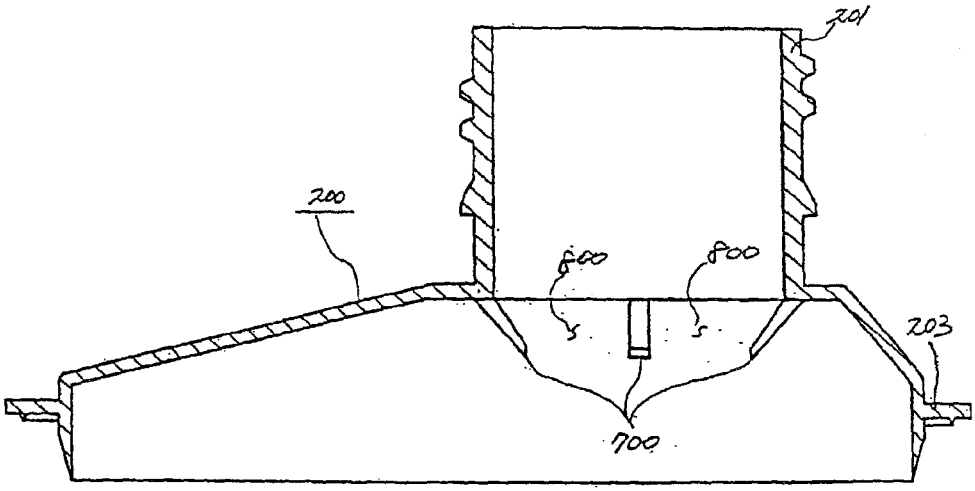
Figure 9:
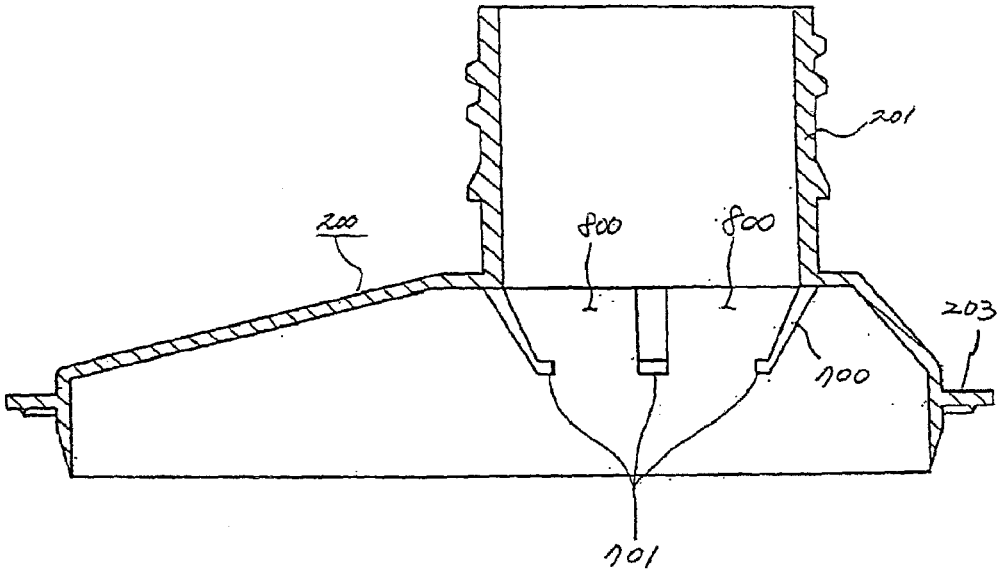

FIGS. 7 through 9 show a fifth embodiment of the present invention.

This embodiment is similar to the first embodiment except for the structure of the lid 200.

The lid 200 is provided with a plurality of inclined exhausting pieces formed on an inner-lower portion of an exhausting portion 201. Extreme ends of the exhausting pieces are disposed on an edge of the inner cap body 216.

An exhaust space 800 through which the secondary material 215 stored in a storage chamber 214 formed in the cap body 210 can be exhausted.

As shown in FIG. 9, the exhausting pieces 700 is provided with a bending portion 701 interposed between the upper edge of the inner cap body 216 and the lower end of the storage tube 213. When the storage tube 213 ascends, the inner cap body 216 can be effectively separated.

In the above-described embodiment, when the cap body 210 is separated from the exhausting portion 201, the storage tube 2134 ascends. At this point, the exhausting pieces 700 cannot ascend as they tightly contact the end of the inner cap body 216, thereby separating the inner cap body 216 is separated from the storage tube 213. As a result, the secondary material 215 falls down to the container main body 100 through the exhausting space 800 to be mixed with the primary material contained in the container main body 100.

In addition, by forming the bending portion 701 on the extreme end of the exhausting pieces 700, the inner cap body 2165 cannot ascend as the bending portion 701 is inserted between the upper end of the inner cap body 216 and the lower end of the storage tube 213, thereby more effecting separating the inner cap body 216 from the storage tube 213.

INDUSTRIAL APPLICABILITY

The present invention can be applied to any containers that stores liquid or powder material. The concept of the present invention can be applied to any containers regardless of the material of the container.

The invention claimed is:

1. A cap assembly that can be associated with a container storing a primary material, the cap assembly comprising:

a lid fixed on a top of the container and having an exhausting portion projected upward;

a cap main body detachably coupled to the exhausting portion of the lid and having a storage tube extending downward into the exhausting portion to define a storage chamber for storing a secondary material and a side portion which extends, circumferentially around an external surface of the exhausting portion and is releasably sealed thereto, the storage tube extending from an exterior upper portion to an interior rim positioned in the container;

an inner cap body detachably coupled to the interior rim of the storage tube to thereby seal the secondary material in the storage chamber; and wherein the exhausting portion tightly contacts an outer surface of the storage tube and further includes a plurality of exhausting pieces formed as part of the lid which extend radially inward and into an exhausting space of the container and include bending portions for selectively separating the inner cap body from the storage tube when the cap main body is detached from the exhausting portion thereby allowing the secondary material to enter the container, wherein the bending portions are perpendicular to the side portion of the storage tube and run coextensively with and abut a lip of the inner cap body to thereby separate the inner cap body from the storage tube when the cap main body is detached.

2. The cap assembly of claim 1, wherein the bending portion is projected inward.

3. The cap assembly of claim 1, wherein a top surface of the container and a lower surface of the lid are provided with respective attaching surfaces attached to each other.

4. A cap assembly that can be associated with a container storing a primary material, the cap assembly comprising:

a lid fixed on a top of the container and provided with an exhausting portion and a plurality of exhausting pieces coupled to the exhausting portion and extending radially inward from a lower portion of the exhausting portion;

a cap body detachably coupled to the exhausting portion and having a storage tube extending downward to define a storage chamber for storing a secondary material and a side portion which extends, circumferentially around an external surface of the exhausting portion and is releasably sealed thereto, the storage tube extending from an exterior upper portion to an interior rim positioned in the container; and an inner cap detachably coupled to the interior rim of the lower portion of the storage tube to thereby seal the secondary material in the storage chamber; and wherein the exhausting pieces are coupled to and formed as part of the lid and extend radially inward from the lid and into the container and which contact the edge of the inner cap inserted in the lower end of the storage tube, the exhausting pieces configured to detach the inner cap from the storage tube when the cap body is detached from the exhausting portion thereby allowing the secondary material to enter the container, wherein the bending portions are perpendicular to the side portion of the storage tube and run coextensively with and abut a lip of the inner cap body to thereby separate the inner cap body from the storage tube when the cap main body is detached.

5. The cap assembly of claim 4, wherein the exhausting pieces have a bending portion inserted between an upper end of the inner cap body and a lower end of the storage tube.

* * * * *